United States Patent [19]

Schwartz

[11] 4,351,526

[45] Sep. 28, 1982

[54] DUMBELLS

[76] Inventor: Leonard Schwartz, 3471 Fifth Ave., Pittsburgh, Pa. 15213

[21] Appl. No.: 127,474

[22] Filed: Mar. 5, 1980

[51] Int. Cl.[3] ..... A63B 11/00

[52] U.S. Cl. ..... 272/122; 272/119; 272/DIG. 5

[58] Field of Search ..... 273/81 R, 81 D, 81.4; 272/67, 68, 70, 93, 117, 119, 121–124, 96; 128/60, 61

[56] References Cited

U.S. PATENT DOCUMENTS

| | | | |
|---|---|---|---|
| 1,511,312 | 10/1924 | Alastalo | 272/119 |
| 1,581,235 | 4/1926 | Sorel | 272/67 |
| 1,672,944 | 6/1928 | Jowett | 272/122 |
| 1,917,566 | 7/1933 | Wood | 272/122 |
| 1,991,520 | 2/1935 | Postl | 272/122 |
| 2,509,810 | 5/1950 | Core | 272/122 |
| 2,617,650 | 11/1952 | Landis | 272/122 |
| 2,952,459 | 9/1960 | Moffitt | 272/96 |
| 3,227,455 | 1/1966 | Hulsman | 273/81.4 X |
| 3,322,425 | 5/1967 | Moore | 272/119 |
| 3,565,451 | 2/1971 | Giambazi | 273/81 D X |
| 3,734,493 | 5/1973 | Hasekian | 272/122 |
| 3,880,443 | 4/1975 | Tobin | 273/81 D X |
| 4,029,312 | 6/1977 | Wright | 272/124 X |
| 4,109,908 | 8/1978 | Pugh et al. | 272/119 |
| 4,218,057 | 8/1980 | Wilson | 272/117 |

FOREIGN PATENT DOCUMENTS

| | | | |
|---|---|---|---|
| 1503686 | 10/1967 | France | 272/122 |
| 2220289 | 10/1974 | France | 273/75 |
| 27934 | of 1904 | United Kingdom | 272/68 |
| 2333 | of 1906 | United Kingdom | 272/122 |
| 18840 | of 1912 | United Kingdom | 128/60 |

*Primary Examiner*—Richard C. Pinkham
*Assistant Examiner*—William R. Browne
*Attorney, Agent, or Firm*—Buell, Blenko, Ziesenheim & Beck

[57] ABSTRACT

A dumbell structure is provided particularly adapted for aerobic and related extended-type exercises comprising an elongate body member having a soft, resilient central hand portion, a threaded end at each end of said hand portion, a pair of removable weights threaded on said threaded ends, and an adjustable hand engaging means engaged at each end of said hand portion extending outwardly transversely to the hand portion and then generally parallel thereto to pass around the back of the hand between the knuckles and wrist of a user.

5 Claims, 7 Drawing Figures

DUMBELLS

This invention relates to dumbells and particularly to dumbells adapted for prolonged or extended use in aerobic exercises.

Dumbells have long been used for exercise purposes. In general, dumbell forms heretofore available have been designed for use in arm, shoulder and chest development in a standing position. The dumbells which have heretofore been available have been quite satisfactory for such purposes. Typical of such dumbells are the conventional pair of rounded weights on opposite ends of a straight or slightly elliptical hand grip. There have been modifications of this conventional shape heretofore proposed to extend the usefulness of these devices to increase their effect on strengthening the muscles of the hands and fingers. Typical of such devices are those illustrated in U.S. Pat. Nos. 660,962; 742,393, 756,480, 734,062, 1,229,658, and 1,138,459. None of these devices, however, is satisfactory for use in the correct performance of aerobic exercises in which hundreds or even thousands of repetitions of movement are involved as compared with the relatively few repetitions of conventional dumbells.

Aerobic exercise has been found to be highly effective in adapting the body, particularly its heart muscle and skeletal muscles, to utilize oxygen at higher rates. Running, jogging and walking have accordingly achieved a new dimension in physical fitness regimens. The effectiveness of this training may be augmented to a surprising degree by loading the limbs of the person doing the exercise. Hand and leg weights serve this purpose well; however, the limiting factor in their use is the gripping power of the hand which tends to fatigue more rapidly than the large muscle masses of the arms and legs. Aerobic exercises by their very nature are prolonged in duration, frequently extending over periods in excess of an hour. Thus, the limiting factor of gripping power is a very real and significant and limiting one for such exercises. Wrist weights have been proposed; however, the effective lever arm is lengthened by placing the weights in or on the hands. Moreover, the comfort factor is a real consideration, for wrist weights are frequently uncomfortable and tend to chap the wearer. Weight gloves are a highly satisfactory means of adding the desired weight for aerobic exercise but are limited by inherent practicalities of glove size.

I have invented a dumbell which is highly satisfactory for use in aerobic exercises. Its form is such that the hand can be relaxed periodically and the constant isometric contraction of the hand and forearm muscles which is a severe limit in prolonged exercise with dumbells is reduced markedly. This relaxation serves to increase the blood flow to the gripping fingers and to reduce greatly the likelihood of the muscle spasm which frequently aborts such exercises prematurely when using conventional dumbells and like weights. In my improved dumbell the weight mass may be changed on the handle portion to any desired level and arrangement.

I provide a dumbell having a generally cylindrical hand portion, a threaded end at each of said hand portion, a pair of removable exchangeable weights, one threaded on each of said threaded ends, a hand engaging means engaged at each end of said hand portion, projecting outwardly and sidewise to pass around the back of a user's hand, preferably between the knuckles and wrist. The hand portion is covered with a soft, resilient member and may be contoured with projections and depressions to conform generally to the shape of a user's hand and fingers when in the gripping position. Preferably, the hand engaging means is a strap, padded intermediate its ends and adjustably engaging the ends of the hand portion. Alternatively, the hand engaging means may be a pair of finger-like members integral with the hand portion, one at each end, or a continuous enclosure band. The hand portion may be made of a formed resilient plastic having a central axial steel shaft threaded at its ends; however, alternatively, the entire hand portion and integral finger-like members or band may be formed of a material such as aluminum or of plastic with appropriate padding and resilience. This structure permits the hand to be relaxed during aerobic exercises with the dumbell supported intermittently by a radial or thumb side of the hand as it is typically held in running or jogging.

In the foregoing general description I have set out certain objects, purposes and advantages of my invention. Other objects, purposes and advantages of this invention will be apparent from a consideration of the following description and the accompanying drawings in which.

Figure 1:
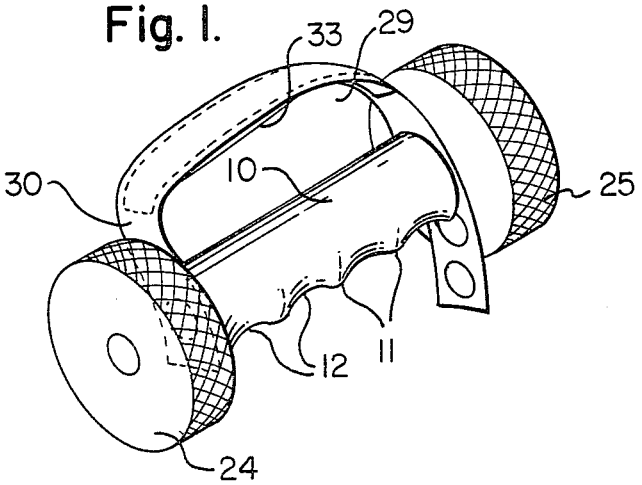
FIG. 1 is an isometric view of a preferred embodiment of this invention.
Figure 2:
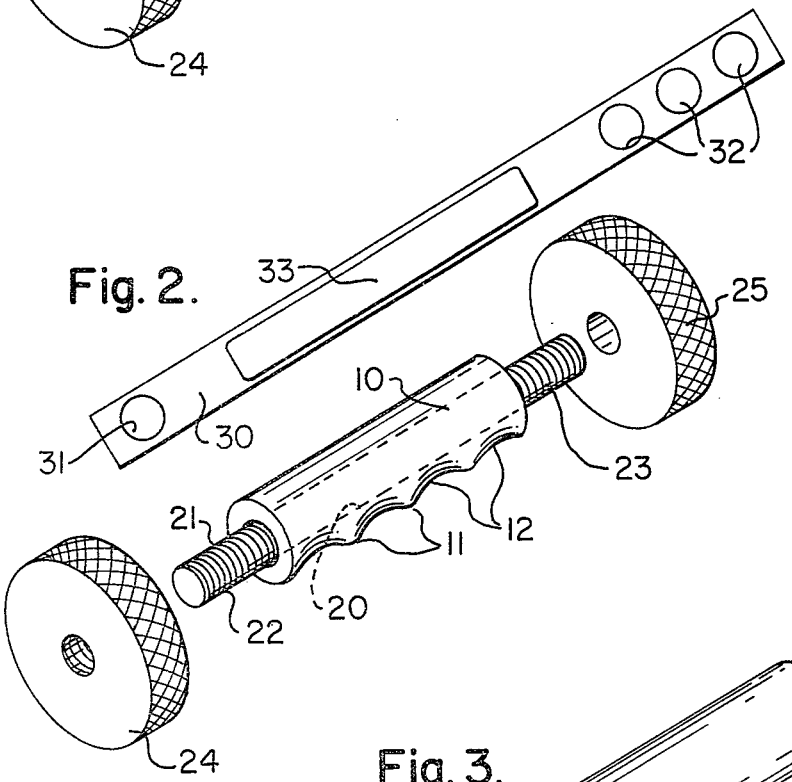
FIG. 2 is an exploded isometric view of the apparatus of FIG. 1.

Referring to the drawings, I have illustrated in FIGS. 1 and 2, a preferred embodiment of dumbell according to this invention. In this embodiment I provide a grip portion in the form of a generally cylindrical resilient plastic body 10 having on its outer surface a series of contoured ridges 11 and valleys 12 for comfortably receiving the fingers of a user's hand. An axial bore 20 through body 10 receives an elongate rod 21 threaded at each end 22 and 23 to receive threaded weights 24 and 25. Weights 24 and 25 can be changed to vary both the amount and position of the weight relative to the user's hand. A hand strap 30 is provided having an opening 31 at one end to pass over one of threaded ends 22 and 23 and a plurality of holes 32 at the other end to pass over the opposite threaded end 22 or 23 from opening 31. A soft resilient pad 33 is preferably provided on strap 30 intermediate its ends to bear on the back of a user's hand between the knuckles and wrist so that the dumbell is held in place even with the user's fingers relaxed.

Figure 3:
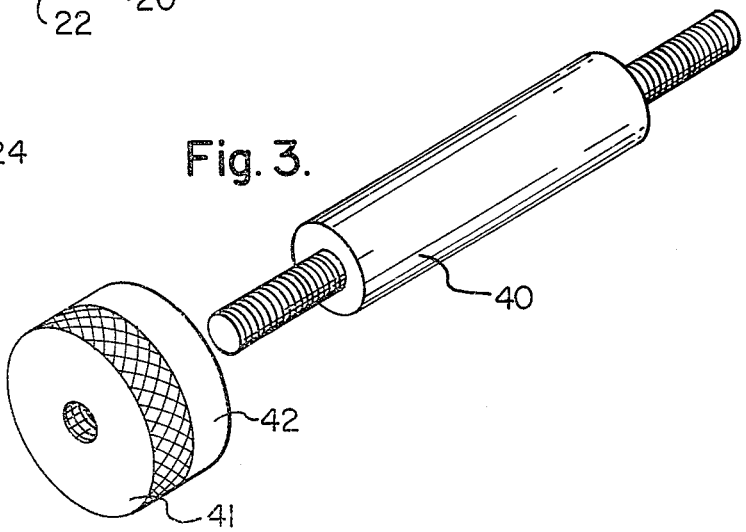
FIG. 3 is an exploded isometric view of a second embodiment of the invention.

In the embodiment illustrated in FIG. 3, a plain bar 40 of oval or round cross section forms the grip portion and the weights may be composite weights having a metal weight portion 41 and a hollow enclosure portion 42 for carrying electronic circuitry or the like for use in connection with exercising. One might, for example, include timers, metronomes, work load calculators, etc. in said enclosure 42.

Referring to FIGS. 4–7, I have illustrated a third embodiment of dumbell according to this invention in which like portions to FIG. 1 are given like numerals with a prime sign. This embodiment includes a grip portion in the form of an elongate generally cylindrical body 10' molded of plastic or aluminum and having on its outer surface a series of contoured ridges 11' and valleys 12' for receiving the fingers of a user's hand. A pair of transverse somewhat resilient fingers 13 and 14, one at each end of body 10', are provided to overlay the back of a user's hand between the wrist and knuckles. The upper projecting finger 13 has a broad portion 15 which extends outwardly a sufficient distance to rest upon the hand of a user between the thumb and forefinger and wrap down behind the hand. The lower projecting finger 14 has a similar broad portion 16 below the hand which extends outwardly a sufficient distance to clear the heel of the hand and wrap behind the hand to contact or approximately contact the upper finger 13.

The cylindrical grip body 10', when made of plastic, has an axial bore 20' receiving an elongate rod 21' threaded at each end 22' and 23', whose threaded ends project beyond the ends of body 10' to threadingly receive weights 24' and 25'. When made of light metal such as aluminum, the bores and rod 21' are formed with the body as an integral portion. Weights 24' and 25' can be interchanged to vary both the amount and position of the weight relative to the user's hand.

Figure 4:
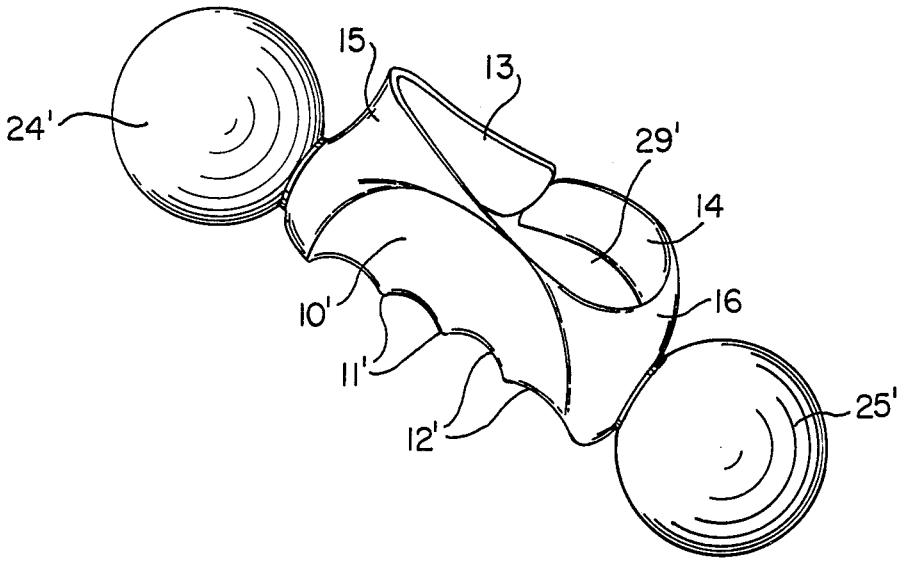
FIG. 4 is an isometric view of a third embodiment of dumbell according to this invention.
Figure 5:
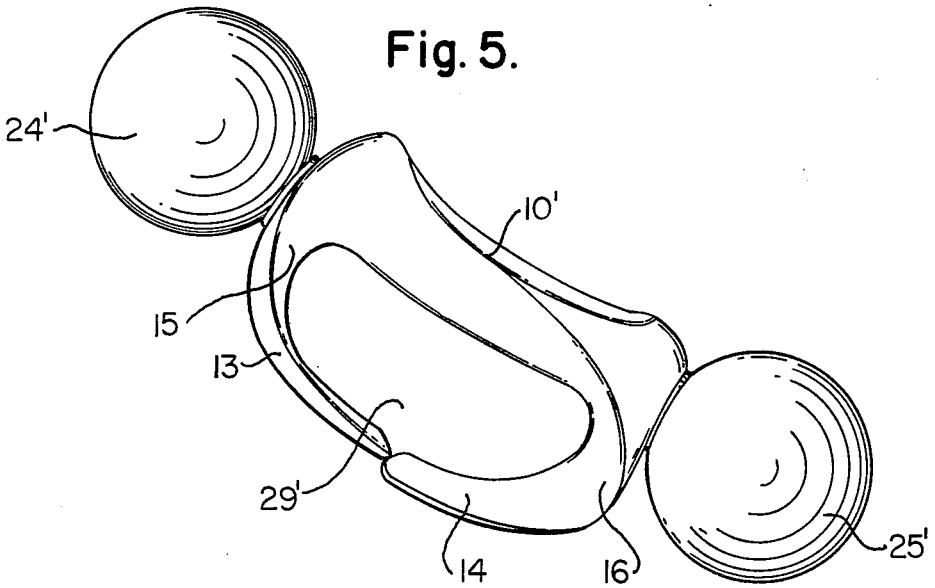
FIG. 5 is an isometric view of the dumbell of FIG. 4 from the opposite side.
Figure 6:
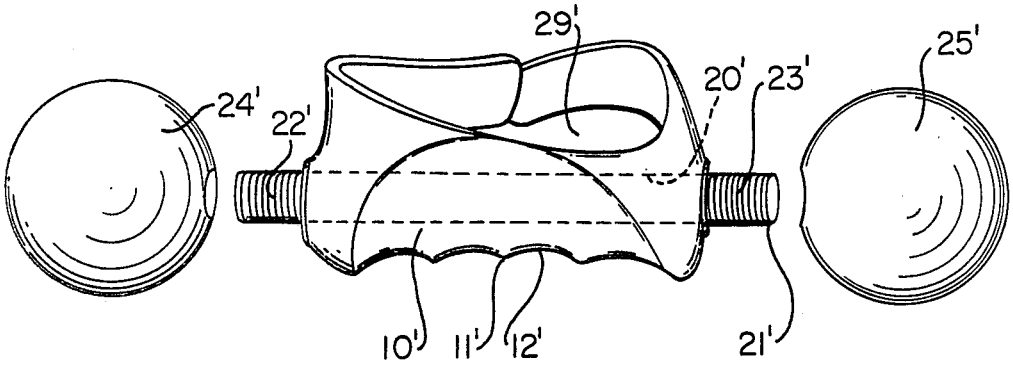
FIG. 6 is an exploded view of the dumbell of FIG. 4.
Figure 7:
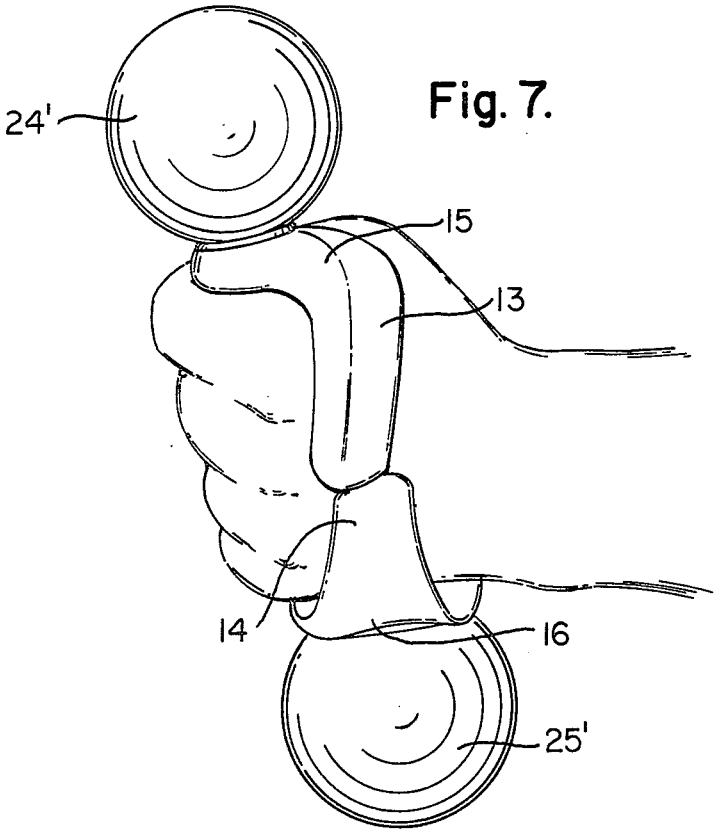
FIG. 7 is an isometric view of the dumbell of FIG. 4 held by a user's hand as in jogging.

To use the dumbell of this invention, the user inserts the fingers of one hand through the passage 29 between cylinder 10 and strap 30, in the case of FIG. 1 or in FIG. 4, fingers 13 and 14 with the desired weights 24 and 25 attached to the end rod 21 and grasps cylinder 10 with the fingers 13 and 14 behind the hand between the wrist and knuckles and with the broad portion 15 of finger 13 resting on the web between the thumb and forefinger. A deep groove may be provided in body 10 and 10' for the user's thumb but this is not essential. In this position, the dumbell will be held on the hand with the fingers relaxed so that its use is not dependent in any way upon the continuous strength of the user's grip.

The grip 10 could be molded of rubber or other material as well as metal or plastic. In the FIG. 4 embodiment the fingers 13 and 14 could be joined as a single member; however, by forming them as a pair of separate fingers, they can spread to accommodate different hand sizes while snugly holding the dumbell in place.

In the foregoing specification I have set out certain preferred practices and embodiments of my invention; however, it will be understood that this invention may be otherwise embodied within the scope of the following claims.

I claim:

1. A dumbell structure particularly adapted for aerobic and related extended time type exercise comprising an elongate rigid body member having a soft, resilient outer covering at the central hand gripping portion thereof, a threaded portion at each end of said body member, a removable weight threaded on each of said threaded ends, and soft conformable hand engaging means engaged at each end of said rigid body member and extending outwardly transversely to said hand gripping portion and then generally parallel thereto to pass around and tightly conform to the back of the hand between the knuckles and wrist of a user, said central gripping hand portion and said hand engaging portion having sufficient resilience between and being spaced apart a sufficient distance so as to engage the hand of a user in such a manner that the structure is capable of being held on the hand without gripping by the fingers and without obstructing blood flow to the hand.

2. A dumbell as claimed in claim 1 wherein the hand engaging means is an elongate strap having openings at opposite ends for engaging the ends of the hand portion.

3. A dumbell as claimed in claim 2 wherein said strap has a resilient pad means intermediate its ends.

4. A dumbell as claimed in one of claims 1 or 2 or 3 wherein the central hand portion is formed of plastic and the central hand portion has an axial bore carrying a rod threaded at each end to receive the removable weights.

5. A dumbell as claimed in claim 1 or 2 or 3 wherein the central hand portion is molded with ridges and valleys contoured to a user's hand.

* * * * *